US005833072A

United States Patent [19]

Lambelet, Jr.

[11] Patent Number: 5,833,072

[45] Date of Patent: Nov. 10, 1998

[54] DOSAGE REGIMEN CONTAINER

[75] Inventor: Lawrence E. Lambelet, Jr., Flemington, N.J.

[73] Assignee: Ortho Pharmaceutical Corporation, Raritan, N.J.

[21] Appl. No.: 891,234

[22] Filed: Jul. 10, 1997

[51] Int. Cl.[6] ..... B65D 83/04

[52] U.S. Cl. ..... 206/534; 206/539

[58] Field of Search ..... 206/528, 531, 206/532, 534, 538, 539; 283/62, 117

[56] References Cited

U.S. PATENT DOCUMENTS

| | | | |
|---|---|---|---|
| Re. 35,445 | 2/1997 | Pora | 206/459.5 |
| D. 355,131 | 2/1995 | Kusz et al. | D9/560 |
| D. 363,661 | 10/1995 | Lambelet, Jr. et al. | D9/423 |
| D. 372,867 | 8/1996 | Lambelet, Jr. | D9/456 |
| 3,324,995 | 6/1967 | Sharp, Jr. | 206/534 |
| 3,381,808 | 5/1968 | McGraw, II | 206/534 |
| 3,397,671 | 8/1968 | Hartman, Jr. et al. | 206/534 |
| 3,494,322 | 2/1970 | Dubbels | 206/534 |
| 3,579,883 | 5/1971 | Hayes | 206/534 |
| 3,630,171 | 12/1971 | Huck | 206/534 |
| 4,974,729 | 12/1990 | Steinnagel | 206/534 |
| 5,050,739 | 9/1991 | Hannan et al. | 206/534 |
| 5,551,567 | 9/1996 | Malone et al. | 206/469 |
| 5,551,597 | 9/1996 | Lambelet, Jr. et al. | 221/197 |
| 5,562,231 | 10/1996 | Lambelet, Jr. et al. | 221/5 |
| 5,570,810 | 11/1996 | Lambelet, Jr. et al. | 221/86 |
| 5,664,697 | 9/1997 | Lambelet, Jr. et al. | 221/5 |

*Primary Examiner*—Jim Foster
*Attorney, Agent, or Firm*—Paul A. Coletti

[57] ABSTRACT

Generally, this invention relates to dosage containers. More specifically this invention relates to dosage containers which help identify a daily regimen of dosages, or a particular time period of dosages in a day. Most specifically, this invention relates to a dosage container which provides dosages in a linear fashion in a one-to-one relationship for the date or timing of dosages, where such dosages are contained on a card, with a blister package holding the dosages.

6 Claims, 3 Drawing Sheets

DOSAGE REGIMEN CONTAINER

FIELD OF THE INVENTION

Generally, this invention relates to dosage containers. More specifically this invention relates to dosage containers which help identify a daily regimen of dosages, or a particular time period of dosages in a day. Most specifically, this invention relates to a dosage container which provides dosages in a linear fashion in a one-to-one relationship for the date or timing of dosages, where such dosages are contained on a card, with a blister package holding the dosages.

BACKGROUND OF THE INVENTION

Pharmaceutical dosages come in all shapes and fashions. Users are quite familiar with dosages contained in bottles to be used over a period of time, perhaps to fill out a prescription. Over-the-counter drugs can be provided in such bottles, and can be used over long periods of time. Certain particular prescriptions also can be provided on a more regimented and defined dosage configuration. For instance, contraceptives can be provided on monthly cycles. Thus, oral contraceptives have been known to be contained in circular cards which can be emplaced in a refillable package whereby the package can be rotated from one day to the next in order to obtain correct pill for that particular day. This can be quite critical in order to receive the proper dosage for that particular day.

Weekly dosages pose an additional problem. Because a weekly dosage has seven days, it is not easily divisible into a thirty day package, or in fact, into packages other than multiples of seven. Because some prescriptions must be filled on fifteen or eighteen or thirty day cycles, there is no convenient way to divide seven days into such numbers. Thus, the user is faced with the problem of being provided with a package which adequately divides out the dosage pills, while conforming to social constrictions of amount of pills provided per prescription.

Also, some pharmaceuticals are taken in more irregular dosage configurations than on a monthly basis. For instance, some pharmaceuticals must be taken on a weekly basis. Such pharmaceuticals regimens are inconvenient to place in a monthly dosage form comprising, for instance, thirty days, because it cannot be certain that a weekly regimen will apply to such thirty day cycle. Alternately, to provide weekly circular cards for monthly holders is inconvenient, as the user will be indexing the holder for only seven of the twenty-one, twenty-eight, or thirty days. Thus, there should be a different way to provide for such unusual dosages.

Compliance packages, such as oral-contraceptive and hormone-replacement-therapy packages, typically combine a unit dose format with a memory aid to keep track of a preferred date or time for dose administration. Unit dose, wherein each does is compartmentized separately, may be constituted in a blister package. The memory aid may be an array of indicators, such as a calendar, which is placed in one-to-one correspondence with the does to identify it with a date or time.

In the simplest form, the memory aid is provided to the user with a fixed starting indicator. The regimen can only begin at a preset date or time. It is desirable in many cases, however, to have a variable system wherein the user "sets-up" the package for a customized regimen. When the regimen has a repeat unit that matches the indicator repeat, such as a weekly unit of seven daily doses, the memory aid requires a single registration to the first does to serve for all repeats. Circular layouts are particularly adaptable in this manner.

The situation is more complex when the regimen repeat differs from that of the indicator repeat. This will occur, for example, when the regimen repeat is six daily doses. To maintain regimen continuity, each repeat will begin on a different day-of-the-week requiring a confusing multiplicity of set-ups. Moreover, simple layouts, such as circles and grids, may produce misleading indicating systems resulting in compliance error.

SUMMARY OF THE INVENTION

The above cited problems are obviated in a dosage regimen container which provides a dosage regimen on a linear strip. This linear strip is a typical blister package containing single dosage pills or tables in each daily dosage format. This dosage strip is emplaceable in a dosage day identifier which can be placed over the strip. The identifier is able to identify a particular dosage to a particular date or time in a one to one relationship. Furthermore, the container comprises a package into which the strip and identifier can be placed. In addition, the identifier has a plurality of holes into which the dosages from the dosage strip can be placed.

The identifier is shaped as a bi-folded card. Uniquely, if the bi-folded card contains a pair of seven hole strips arranged in parallel fashion about the center line of the card, so that the seven hole strips can be placed one on top of the other to form a through hole to each dosage regimen, there are contained eight possible arrangements to place the card, as will be further described herein. With the eight possible arrangements, for instance, there can be arranged seven different arrangements to start the dosage regimen on any particular day. The eighth arrangement can be used for instructions, for instance. Thus, this particular arrangement can be used to begin the dosage regimen on any day of the week independent of when the user fills up a prescription. This makes the currently described regimen container and package "universal" with respect to weekly prescriptions.

The present invention is drawn to the aforementioned problem of a variable-start-day date/time memory aid operable where the regimen repeat is other than a natural cycle of date or time. The regimen is first divided into blister strips comprised of linear arrays of the repeat unit. In this way, each unit can be handled independently, and the resetting process is forced as the strip becomes depleted. If the regimen contains, for example, 30 doses comprised of five repeats of six doses each, some measure of convenience and portability is also afforded by the subdivision into strips of the repeating dosage in a linear array.

A memory aid is provided in a bi-folded card of plastic or cardboard construction. The card has two sets of holes with each hole shaped and sized to encircle the blister cavity. The count of holes in each set corresponds to the repeat dosage unit. The holes are arranged symmetrically on the card such that the two sets are in alignment with the card is folded on a bisecting score line or hinge. They are arranged spatially to correspond to the blister strip cavities.

Margins above and below each set of holes are labeled with indicators. Since the card can be folded in two directions, margins are available in eight locations for an indicator sequence, four facings times two orientations per facing. The indicator sequences on any one facing will be in inverted image so that an "active" location is made apparent by the "right-up" orientation. If the indicator scheme is the seven-days-of-the-week, the eight locations will produce a complete set of start-day options with one location to spare. It can be seen that any number of repeat unit doses will be accommodated with this arrangement.

The blister strip is sandwiched between the folded halves of the card such that the blister cavities protrude through the holes on the top and the dose is aligned to extrude through the holes on the bottom. The card is oriented to the blister strip so that the selected indicator is positioned at the starting dose. A holder may be provided to house the composite structure and prevent separation of the component parts. The holder may also serve to mask all but the active indicator sequence. When the strip is spent, the waste is removed, the start indicator is reselected by manipulations of the card, and the next unit of the regimen is loaded. The process continues with each strip until the end of the regimen.

DETAILED DESCRIPTION OF THE DRAWINGS

The above described invention can be better understood in connection with the attached drawings and figures, in which:

FIG. 1 is an exploded perspective view (directions to the illustrator) of the container showing the assembly of the strip, bi-folding card and holder;

FIG. 2 is a plan view of the bi-folding card showing one-fold option;

FIG. 3 is a plan view of the bi-folding card showing an alternative fold option;

FIG. 4 is a plan view of the blister strip;

FIG. 5 is a cross-sectional view of the assembled container and contents; and FIG. 6 is an exploded perspective view (directions to the illustrator) of an alternative holder.

DESCRIPTION OF THE DRAWINGS

As best shown in FIG. 1, container 10 is comprised of containing envelope 11 and an attached panel 12. The attached panel 12 is comprised of the means for holding, said means being pocketed holder 13, and is hinged at hinge 14 to fold into a compact arrangement with the containing envelope 11.

Figure 4:
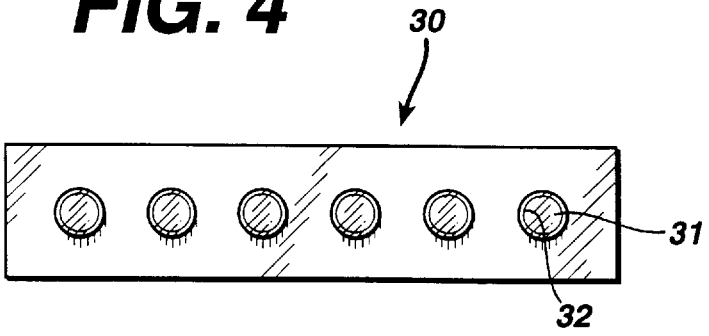
Figure 5:
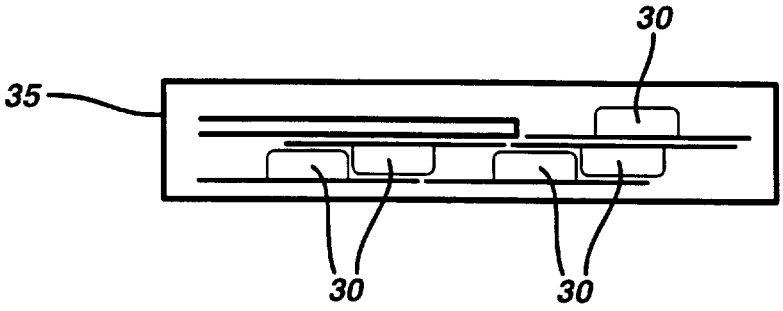
FIG. 5 is a cross-sectional view of the components loaded into containing envelope 11 which is sized appropriately for the load.

Blister strip 30 is best viewed in FIG. 4. One or more blister strips may comprise the dosage regimen. For example, five such blister strips 30 are shown loaded into containing envelope 11 in the cross-sectional view of FIG. 5. The blister strip 30 contains a multiplicity of dosage units 31 corresponding to a dosage cycle. In this embodiment the dosage cycle is six dosage units. The dosage units may vary in any physical or chemical way with the repeat pattern defined as the cycle length. The dosage units 31 are arrayed linearly to facilitate labeling and each dosage unit is separately housed in a blister cavity 32. The intervals between adjacent blister cavities 32 are uniform and equivalent for each blister strip 30.

Figure 2:
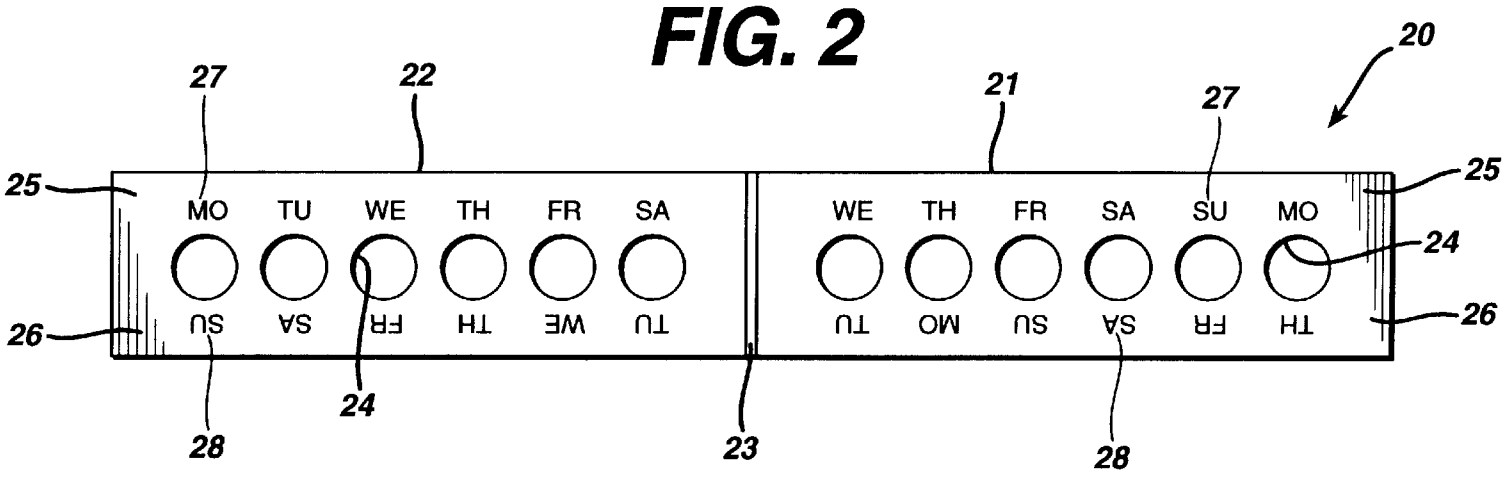
Figure 3:
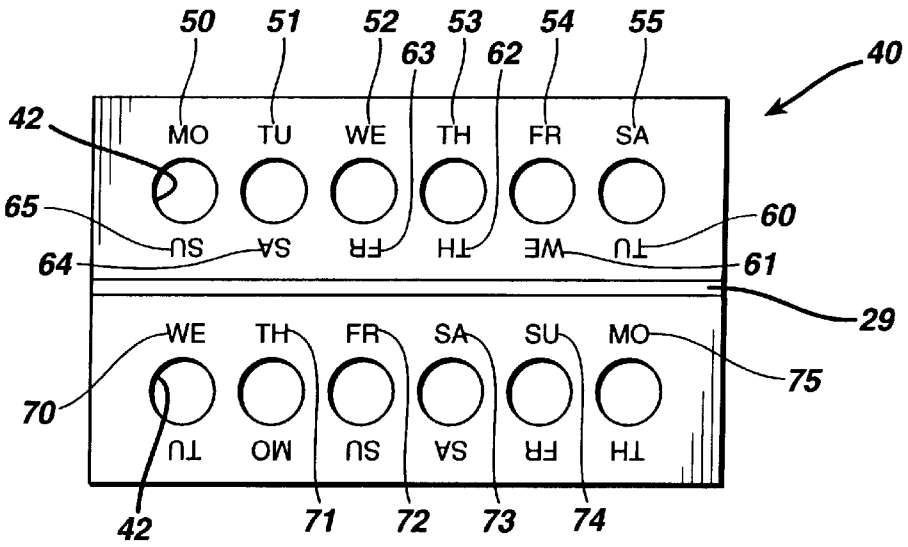

The bi-folding card 20 is shown in two equivalent forms in FIG. 2 and 3. Referring now to FIG. 2, the bi-folding card 20 is divided into halves 21 and 22. The halves 21 and 22 are connected at two side edges by a first articulating hinge 23. Each of the halves contains a set of holes 24 sized and spaced to correspond to the blister cavities 32 arrayed upon the blister strip 30. The range of the first articulating hinge 23 is sufficient to permit half 21 to be folded onto half 22 such that either the front facings are opposed or, alternatively, the back facings are opposed. In this manner, a total of four surfaces can be exposed. The symmetry of holes 24 is such that the set from each half is aligned in the folded position. The bi-folding card 20 is sufficiently long for the blister strip 30 to be sandwiched between opposing facings of the card. With proper assembly, the blister cavities 32 protrude through one set of holes 24 while the second set of holes 24 occupy the exit position behind. Each of the halves 21 and 22 have two top margins 25, one on the front and one on the back, and two bottom margins 26, also front and back. It can be shown that there are a total of eight margins which can be exposed. Each of the top margins 25 can be supplied with a serial of operating indicators 27 in correspondence with the holes 24. Similarly, each of the bottom margins 26 can be supplied with a serial of inverted indicators 28. It can be shown that each of the inverted indicators 28 can be rotated into a correct reading position, thereby transforming it into an operating indicator 27, and that any one exposed surface has only one readably-oriented indicating scheme. The operating indicators 27 and the inverted indicators 28 can each be given a unique serial so that eight starting options are provided. In the preferred embodiment, the serials are days-of-the-week, and seven of the eight margins can be provided with a unique starting day. The eighth margin can be used for a message. The halves 21 and 22 can alternatively be joined along top and bottom edges by a second articulating hinge 29, as shown in FIG. 2. It can be shown that second articulating hinge 29 provides identical functionality.

Figure 1:
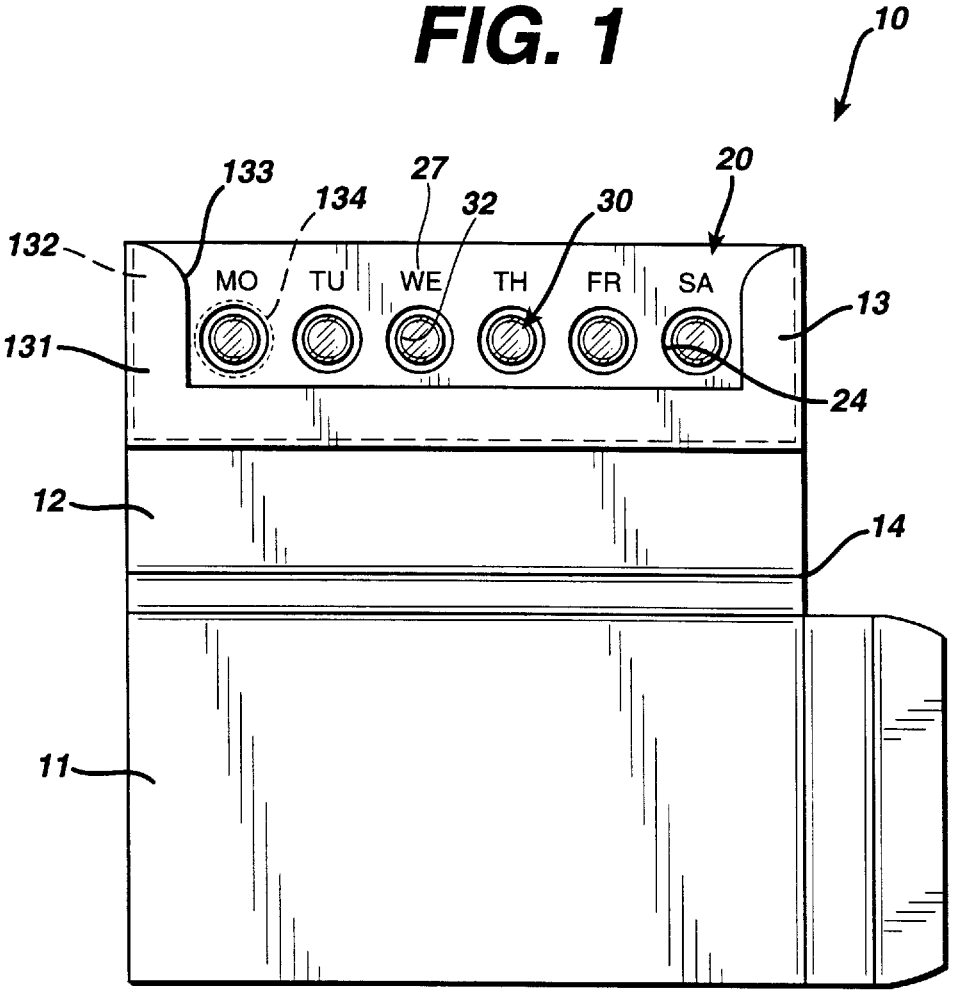
FIG. 1 is an exploded view illustrating the assemblage of several component parts including a means for containing, a means for holding, a means for indicating, and a linear dosage strip constituting a subunit of the dosage regimen. In the preferred embodiment, the means for containing and the means for holding are combined into the unit structure, container 10. The bi-folding card 20 represents the means for indicating in this preferred embodiment. Also shown in this view is the linear dosage strip, blister strip 30.
Figure 6:
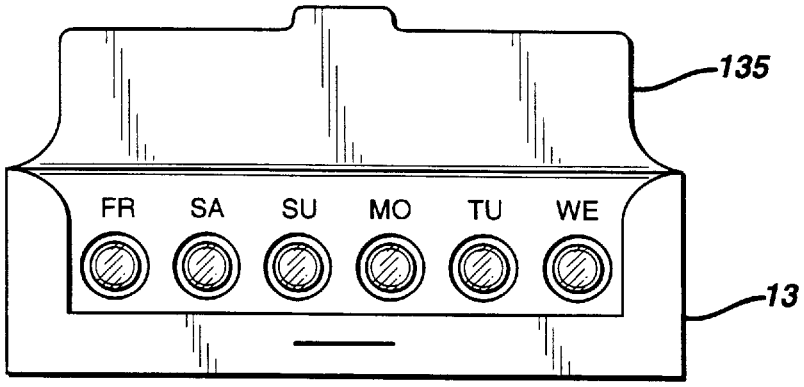

The preferred version of the pocketed bolder 13 is illustrated in FIG. 1. FIG. 6 shows an alternative version which is separated from the container 10. Referring now to FIG. 1, pocketed holder 13 is comprised of a front panel 131, a back panel 132 only a portion of which is shown and a pocket 133 therebetween. The back panel 132 and pocket 133 form a connected panel structure or strip holding means, wherein pocket 133 is essentially a series of slots 133*a*, 133*b*, 133*c* engageable with card 20 holding blister strip 30. The front panel 131 is open to expose the blister cavities 32 and the operating indicators 27 while overlapping the assemblage of bi-folding card 20 and blister strip 30 sufficiently to restrain it from the front when it is loaded into pocket 133. The front panel 131 also covers the inverted indicators 28 to eliminate any confusion as to intended orientation. The back panel 132 has an apertures or openings 134, seen in phantom through card 20 and blister strip 10 which is sized and located to permit passage of the dosage units 31 through and out of the package when expelled by collapsing the blister cavities 32 during dispensing. The back panel 132 restrains the assemblage of bi-folding card 20 and blister strip 30 in pocket 133 from the back and masks the backside operating indicators 27 and inverted indicators 28 from view. The pocket 133 is formed by joining the front panel 131 and the back panel 132 along the bottom and the two vertical sides. The pocket 133 has sufficient breadth to receive the assembled bi-folding strip 20 and blister strip 30 when inserted into pocket 133 from the open top. The assemblage is held in place by friction from the intimate surfaces of the front panel 131 and back panel 132. In the preferred version, the back panel 132 is extended to form the attached panel 12. In the alternative version of pocketed holder 13 shown in FIG. 6, the separation from container 10 permits portability of the operating dosage strip. In this case, fold-down cover 135 may be provided for extra protection.

As seen in FIGS. 1 through 4, there is described herein a dosage strip 10 which provides a series of dosages of pharmaceuticals for the user. This dosage strip 10 can be arranged as shown in the drawings, with seven pills 12 arranged in linear fashion across the front of the strip. These pills 12 can represent, for instance, a week's worth of dosages of the particular pharmaceutical. Each blister 14 arranged on the dosage strip 10 can be separately pierced to provide the particular dosage 12 to the user on the particularly desired day. Of course, these dosages can be filled out over longer periods of time. Also, these dosages 12 can be taken on a more frequent basis, if desired by the patient as well as the physician.

While this concept of taking a daily dosage is well known, it is the combination of the dosage strip 10 in connection with the dosage day identifier 20 which is described by this invention. The dosage day identifier 20, in this particularly preferred embodiment is a card 22 into which the dosage strip 10 can be placed. The card 22 has a longitudinal arrangement around its center 24 to accommodate all seven dosages 12 to be taken in a particular time frame. Thus, the dosage blisters 14 can be pushed through the holes 26 in the dosage identifier strip 22 and out of the back of the dosage strip 22 in order to apply the dosages. In this fashion, the dosages 12 can be taken one after the other until the particular dosage strips are exhausted. Then, a subsequent dosage strip 10 can be emplaced into the dosage identifier to begin the prescription anew.

As described herein, the dosages 12 contained on the dosage strip 10 as well as the dosage identifier 20 can be combined in one unique package 30. For instance, the dosage identifier 20 can be formed contiguous with a cardboard box 35 arranged on its rear surface. In this fashion, the surface of the dosage identifier 20 can be held over the dosage strip 10 which will be forced against the forward wall of the dosage containing box 35. In addition, the dosage strips 10 can be conveniently placed into the opening in the dosage box. In this fashion, for instance if more than one dosage strips 10 are received in a prescription at any one time, they can be conveniently stored in the box 35 before use in the dosage identifier.

In another unique arrangement, the dosage identifier 20 can further contain a bi-fold identifying card 40. This bi-fold card 40 is shown in FIGS. 3 and 4. It can contain a slot as in the dosage identifier 20 of FIGS. 1 and 2; also, it can have a series of holes 42 punched in it to particularly mate over the dosage identifying strip 20. This dosage identifying card can be folded so that the series of holes on either side of the center of the card align with one another.

What is particularly unique about the bi-fold card 40 is its unique arrangement containing for identifying the dosages to be taken. As can be seen in FIG. 3 the first dosage measurement begins on a Monday as identified by numerical sequence 50 to 56. The second numerical sequence begins on a Tuesday as seen in numerical sequence 60 to 66. The third numerical sequence is arrived by flipping the card but maintaining the fold as seen in sequence 70 to 76, and begins on Wednesday. The fourth similarly begins on Thursday. When the card is flipped so that the arrangement in FIG. 4 is shown, the Friday, Saturday and Sunday sequences begin as shown, similar in fashion to Monday through Thursday. And, the directions can be described in any particular fashion. Here, Applicants have chosen to use the one remaining "unused" side of the card.

Thus, when fully operational the bi-fold card 40 envelopes the dosage strip 10. The bi-fold 40 card can be arranged so that the first day of the dosage regimen is maintained at the left hand side of the dosage strip. The strip and card are emplaced into the dosage identifier 20 so that the dosage strip 10 is immediately available to eject the particular dosages 12. The dosage identifier 20 can be folded back against the dosage box 35 when not in use, there is no danger of the particular dosages being ejected from the dosage identifier 20 or dosage card 40.

It is to be appreciated that multiple such combinations of dates are number of dosages contained in a linear strip are available. Naturally, this invention is intended to encompass all possible combinations and dates, without departing from the scope of the invention. Thus, the present invention is to be determined from the attached claims and their scope and equivalents.

It is claimed:

1. A dosage regimen container comprising:

a dosage strip containing a plurality of dosages arranged linearly on said strip, said dosages each spaced apart from one another on said strip;

a dosage day identifier comprising a card engageable with said dosage strip, said identifier formed with a plurality of holes emplaceable over said dosages and said holes containing markings useful for correlating a particular dosage to a particular date or time in a one-to-one relationship;

a package having a strip holding means into which said strip and identifier can be placed; and said identifier being a bi-fold-fold card; and wherein said package has a plurality of holes arranged in a linear fashion to correspond to said dosages on said dosage strip.

2. The container of claim 1 wherein said card has a plurality of linearly arranged day programs imprinted thereon.

3. A dosage regimen container comprising:

a dosage strip containing a plurality of dosages arranged linearly on said strip, said dosages each spaced apart from one another on said strip;

a dosage day identifier comprising a card engageable with said dosage strip, said identifier formed with a plurality of holes emplaceable over said dosages and said holes containing markings useful for correlating a particular dosage to a particular date or time in a one-to-one relationship;

a package having a strip holding means into which said strip and identifier can be placed; and wherein said package has a plurality of holes arranged in a linear fashion to correspond to said dosages on said dosage strip; and said identifier being a bi-fold-fold card with a pair of linearly arranged plurality of holes, one of said arranged holes placed on either side of said bi-fold-fold.

4. A dosage regimen container comprising:

a dosage strip containing a plurality of dosages arranged linearly on said strip, said dosages each spaced apart from one another on said strip;

a dosage day identifier comprising a card engageable with said dosage strip, said identifier formed with a plurality of holes emplaceable over said dosages and said holes containing markings useful for correlating a particular dosage to a particular date or time in a one-to-one relationship;

a package having a strip holding means into which said strip and identifier can be placed; and wherein said package has a plurality of holes arranged in a linear fashion to correspond to said dosages on said dosage strip; and said identifier being a bi-fold-fold card with a pair of linearly arranged plurality of holes, one of said arranged holes placed on either side of said bi-fold; and wherein said card has a plurality of linearly arranged day programs imprinted thereon.

5. A variable-indicator dosage regimen container comprising:

a plurality of dosage strips each containing a plurality of doses in a blister package, the dosage strips arranged linearly such that each dose is compartmentized in a separate blister cavity with frangible lidding;

a bi-folding card divided into two equal sections and hinged therebetween, each section containing holes engaged with blister cavities of the dosage strip with margins at the top and bottom, the two sections being brought into alignment by folding the card around the dosage strip in a manner to sandwich it between the sections, the alignment of holes providing means for dispensation of the dose by pushing it through the frangible lidding, the top and bottom margins providing space for labeling a day or time for each cavity, such labeling on the bottom margin being placed upside down to differentiate a selected margin by right-up orientation, the top and bottom margins having four facings accessible by manipulation of the hinge to present eight sequences of day or time; and a container of folding carton construction sized to house the strips and the bi-folding card, the container having a connected panel providing slots to receive and hold the composite strip and bi-folding card structure in any current operation, the panel having openings corresponding to the holes in the bi-fold card and in registry therewith, said openings sized to permit the display of the operating day or time sequence of said bi-fold card therethrough and said openings further permitting the dispensation of the doses therethrough while simultaneously having means for masking all other day or time sequences.

6. A dosage regimen container comprising:

a dosage strip containing a plurality of dosages arranged linearly on said strip, said dosages each spaced apart from one another on said strip;

a dosage day indentifier comprising a card engageable with said dosage strip, said identifier formed with a plurality of holes emplaceable over said dosages and said holes containing markings useful for correlating a particular dosage to a particular date or time in a one-to-one relationship;

a package having a strip holding means into which said strip and identifier can be placed; and said identifier being a card; and wherein said package has a plurality of holes arranged in a linear fashion to correspond to said dosages on said dosage strip.

* * * * *